United States Patent [19]

Bourgeois, Jr.

[11] Patent Number: 4,572,301

[45] Date of Patent: Feb. 25, 1986

[54] ADJUSTABLE SPREADER-GRADER

[75] Inventor: Leverence Bourgeois, Jr., Metairie, La.

[73] Assignee: Ivy J. Foret Associates, Inc., Metarie, La.

[21] Appl. No.: 571,703

[22] Filed: Jan. 18, 1984

[51] Int. Cl.[4] ..... E01C 19/22

[52] U.S. Cl. ..... 172/445.1; 172/684.5; 172/776

[58] Field of Search ..... 172/445.1, 445.2, 446, 172/776, 476, 741, 684.5, 254, 253, 799.5

[56] References Cited

U.S. PATENT DOCUMENTS

| | | | |
|---|---|---|---|
| 1,509,189 | 9/1924 | Carlson | 172/684.5 |
| 1,755,631 | 4/1930 | Burnett | 172/776 X |
| 1,838,570 | 12/1931 | Pridgen | 172/787 |
| 2,620,716 | 12/1952 | Ciancio | 172/445.1 |
| 2,815,591 | 12/1957 | Mattingly | 172/445.2 |
| 4,320,988 | 3/1982 | Seal | 172/445.1 |

FOREIGN PATENT DOCUMENTS

| | | | |
|---|---|---|---|
| 2009059 | 9/1970 | Fed. Rep. of Germany | 172/776 |
| 1416516 | 9/1965 | France | 172/776 |
| 184024 | 11/1966 | U.S.S.R. | 172/445.1 |

*Primary Examiner*—Richard J. Johnson

*Attorney, Agent, or Firm*—Lalos, Keegan, Marsh, Bentzen & Kaye

[57] ABSTRACT

An improved tractor pulled earth mover is shown. The improved earth mover is a two-bladed earth scraper having two parallel blades mounted between two supporting side plates. The side plates define a level of ground with respect to which the earth grader is dragged. The side plates have a supporting structure including a mounting for a standard three point hitch for a tractor to permit manipulation, application, dragging and removal of the earth grader. Between the two side plates are located two parallel rigidly mounted blades having three settable depths found specifically advantageous for grading respectively loose sand, coarse aggregates such as rocks, and compacted dirt. The invention discloses a particularly advantageous geometric relationship between the blades and among the blades for optimum grading effectiveness. In operation, the improved earth grader is mounted by fastening to a three point hitch of a standard farm tractor, is held by the existing three point hitch apparatus of the standard farm tractor in contact with the ground and is dragged behind the farm tractor to provide a particularly uniform smooth graded surface over numerous terrain variants.

11 Claims, 5 Drawing Figures

ADJUSTABLE SPREADER-GRADER

BACKGROUND OF THE INVENTION

The current invention relates to the field of towed earth grading or earth scraping apparatus.

Multi-bladed passive earth grading apparatus have been known in the art. Typical of these is the unpatented tractor towed twin blade earth grader commercially sold as a terra-plane sold in the southern United States during the early 1960's. The terra-plane consisted of two blades rigidly mounted between side plates. The entire array being towed by a tractor for earth scraping purposes.

A more elaborate version showing hydraulic actuating means for rotating at least one blade differentially with respect to the second blade is shown in Seal, U.S. Pat. No. 4,320,988. Seal teaches a technique involving the hydraulic rotation or twisting laterally of a spreader blade so as to control the effectiveness of the cut.

The initial multi-bladed passive earth grader mechanisms were ineffective inasmuch as they were suited for only one general type of terrain from their construction and when used on different media, that is when transferred for example, sand to compacted earth, to shell or coarse aggregates, they would become ineffective in efficiently creating a smooth level surface.

The attempt to correct this problem as shown in Seal by differentially twisting the blades produced an extremely highly stressed structure which is prone to breakage and in fact, the Seal mechanism, as patented, is not believed to be in commercial use due to its unsatisfactory performance.

SUMMARY OF THE INVENTION

The current invention discloses a twin bladed passive earth grading apparatus having a unique multi-positional mounting specifically disclosed so as to permit the apparatus to be readily modified and adapted for use on any of a number of varying terrain types so that optimum performance may be obtained in grading a wide range of commonly encountered ground media.

The invention further discloses a particularly advantageous geometric arrangement of the blades with respect to the side skids so as to optimally effect smooth level grading.

It is thus an object of this invention to disclose a passive earth grader having a particularly efficient geometric construction for effective level grading.

It is a further object of this invention to disclose a particular arrangement of an earth grading apparatus permitting ready adaptation to any of a number of varying ground media.

It is a further object of this invention to disclose a construction technique for a passive spreader/grader permitting the construction of a number of graders of different widths from the same basic cell assemblies having the same improved characteristics.

These and other objects of the invention will be more clearly seen from the detailed description of the embodiment which follows and the claims.

DETAILED DESCRIPTION OF THE PREFERRED EMBODIMENT

Figure 1:
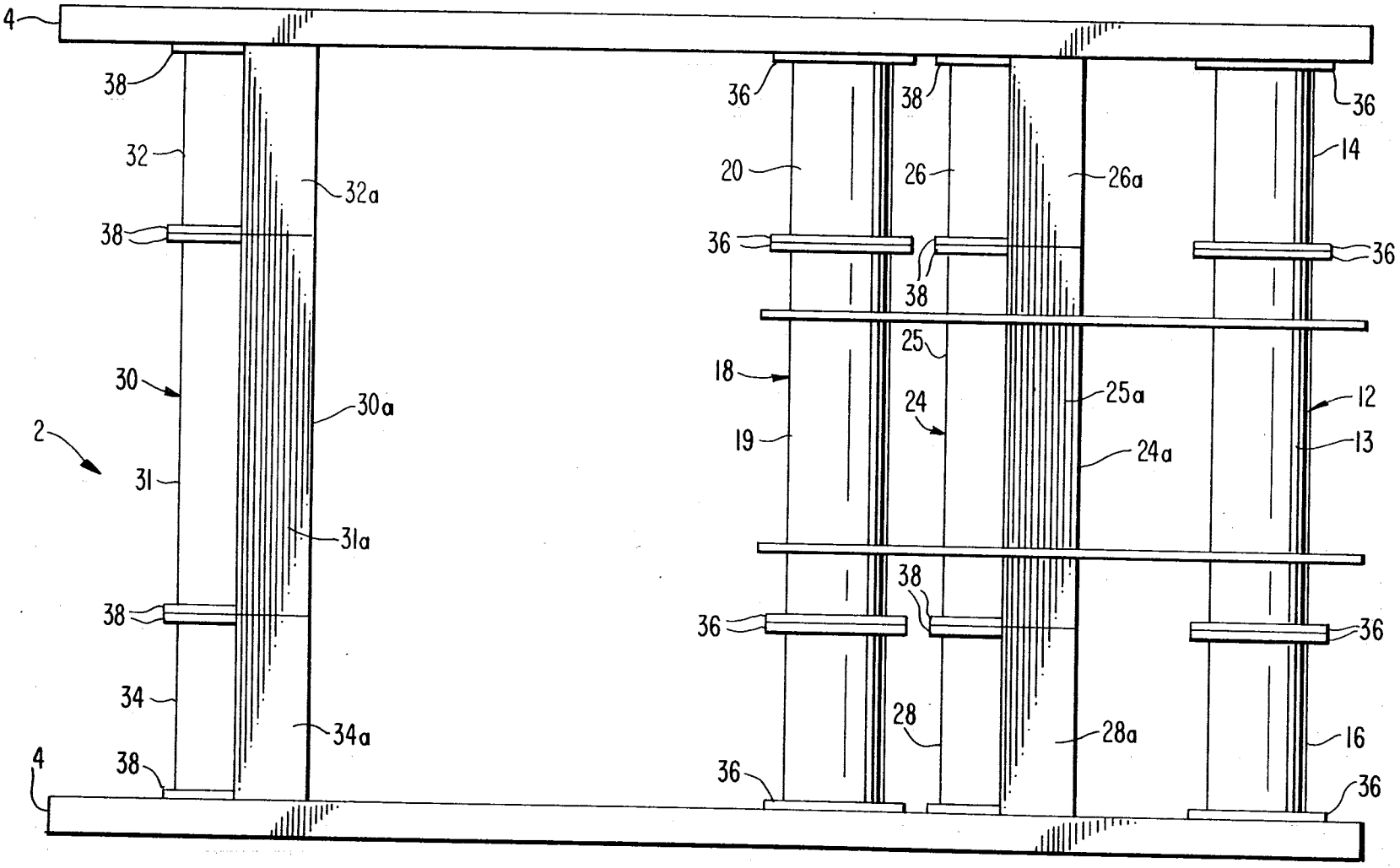
FIG. 1 is a top view of the improved spreader/grader showing the improved construction technique.
Figure 2:
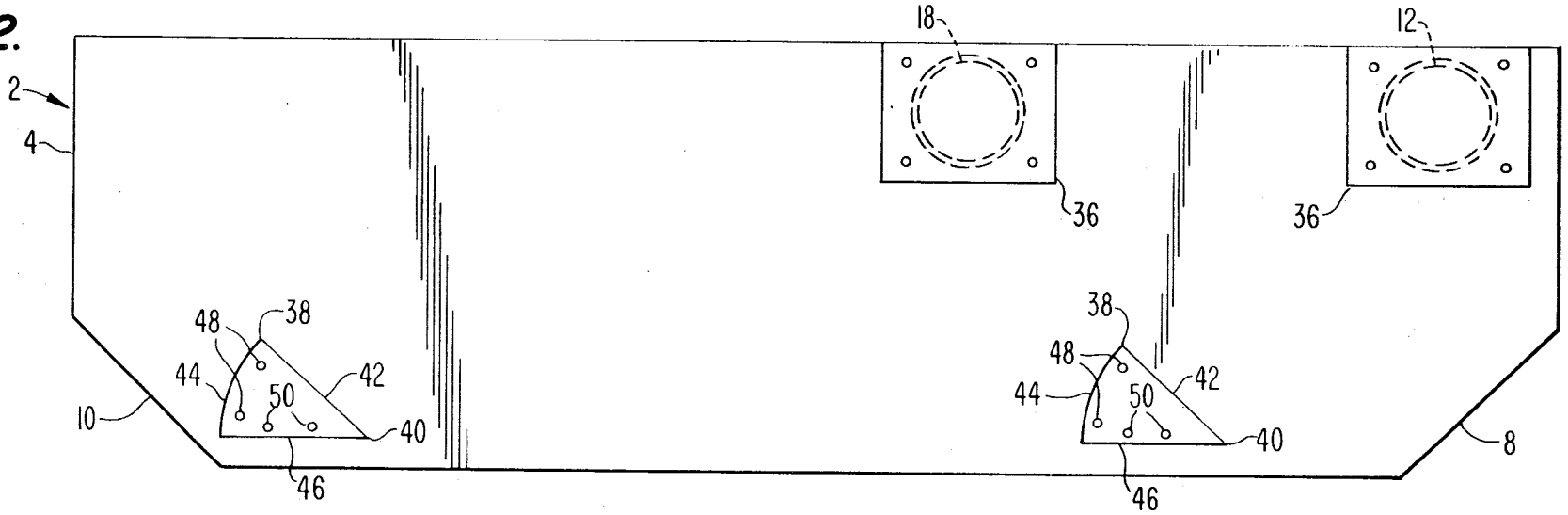
FIG. 2 is a side view section of a skid of the improved spreader/grader showing one aspect of the improved spreader/grader geometry.
Figure 3:
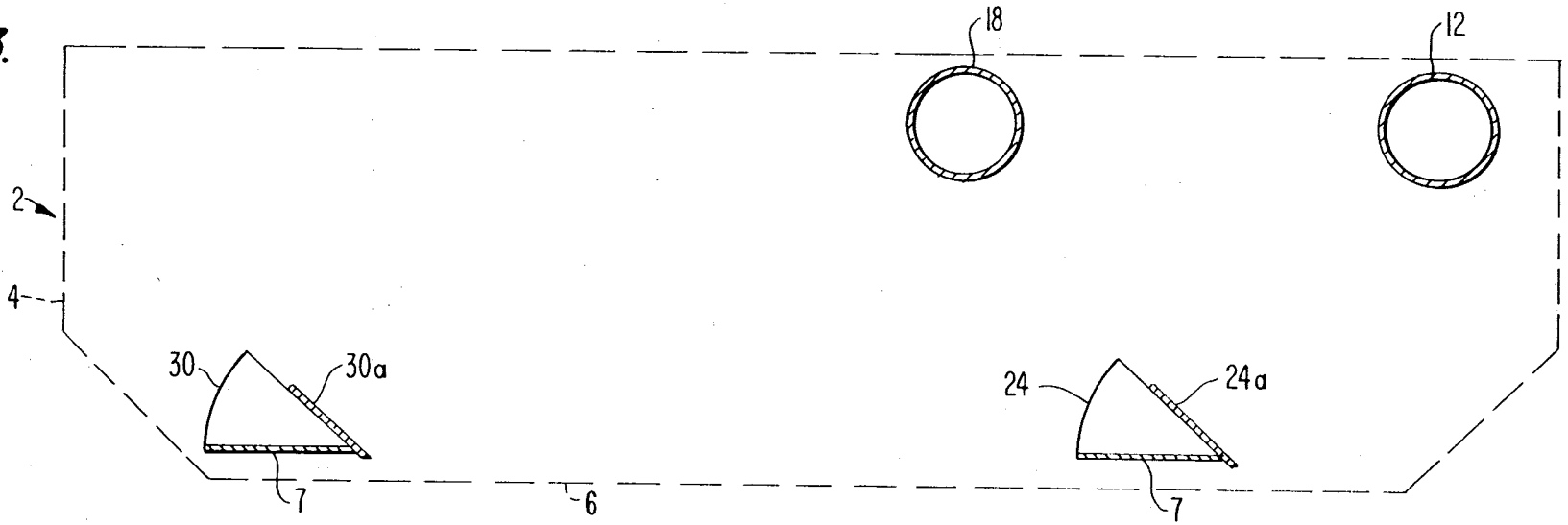
FIG. 3 is a section through the improved spreader/grader showing a second aspect of the improved geometry.
Figure 4:
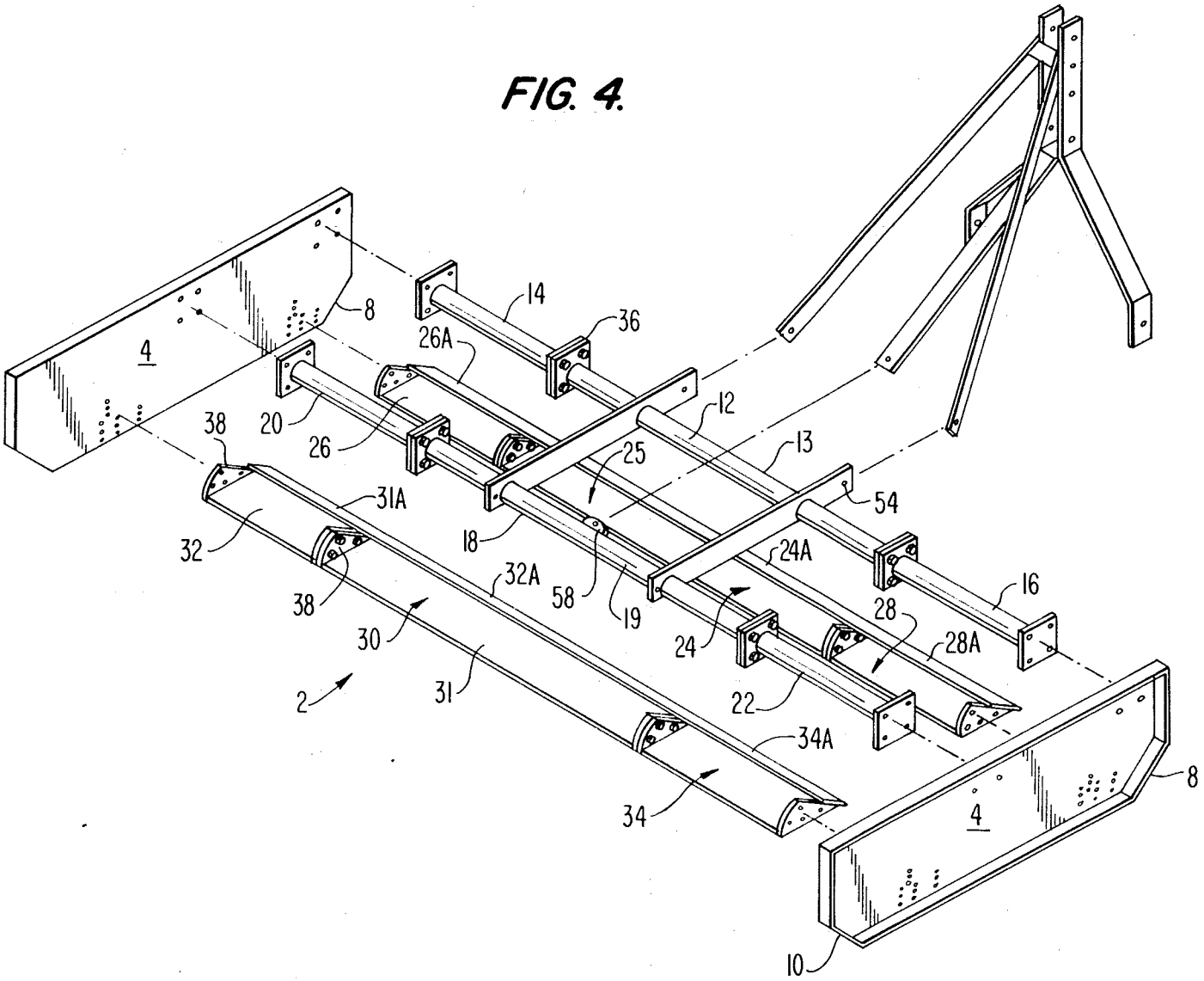
FIG. 4 is a perspective partially-exploded view of the improved spreader/grader.
Figure 5:
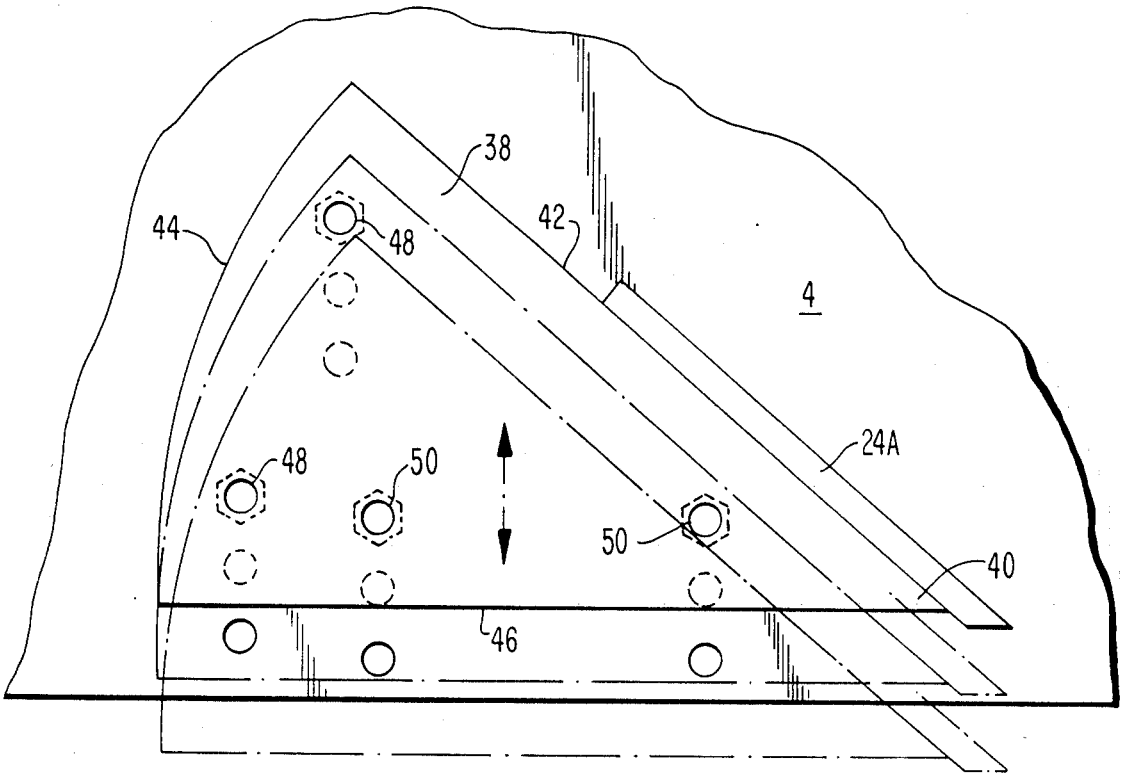
FIG. 5 is an enlarged cross-section view of the end connections of the improved spreader/grader.

Turning to FIGS. 1, 2 and 3 in combination the improved grader 2 is shown to comprise two side plates 4, forming the outer extension and the fore and aft dimensions of the overall grader 2.

In addition, the side plates 4 define a side plate base plane 6 which is the point of contact of the side plates with the media to be graded, not shown; the combined effects of the weight of the grader 2 and the dynamics of the tractor pull, not shown, are such that the side plate base plane 6 may be either slightly above or more often may be a depth beneath the surface of the media being graded.

Each of the side plates 4 is provided with a side plate taper entry 8 and a side plate taper exit 10 to lessen the effort required to pull the overall grader 2 through the media being graded.

Turning to FIG. 1 the grader 2 is seen to comprise the following major subassemblies installed between the side plates 4. A fore cross member 12 and an aft cross member 18 are provided between the two side plates 4, cross members 12 and 18 provide the major structural strength for the grader 2. They are intended to absorb most of the side forces and loading between the side plates 4 and to support the side plates for a fixed distance apart. Fore cross member is further seen to comprise a center section 13, and in the embodiment shown herein a first cross member extension 14 intermediate the center section 13 and one of the side plates 4; and a second cross member extension 16, intermediate the center section 13 and a second side plate 4. Likewise, cross member 18 is seen to, in this embodiment, further comprise a center section 19; a first cross member extension 20 intermediate center extension 19 and a side plate 4; and a second cross member extension 22 intermediate extension 19 and a second side plate 4.

In an analagous manner, they may be seen a first blade support 24 located on the forward end of the overall grader 2 intermediate the two side plates 4 and adjacent to the side plate base plane 6. A second blade support 30 also intermediate the side plates 4 is seen to be located towards the rear of the overall grader 2 and adjacent the side plate base plane 6. Each of the first blade supports 24 and the second blade supports 30 are at an equal distance with respect to the side plate base plane 6 that is, they define a greater plane 7 which is parallel to the side plate base plane 6, an offset therefrom by a distance to be discussed later. The first blade support 24 has installed upon its lower forward edge a first blade member 24A. First blade support 24 is seen with respect to FIGS. 2 and 3 to comprise an essentially forward angled triangular structure and, in the preferred embodiment is constructed of a mild weldable steel. It is important that the first blade support 24 be relatively ductile with respect to blade member 24A. Blade member 24A, as is well known in the art, is an extremely hard and therefore brittle blade edge piece of common well-known design.

First blade support 24 is further seen to comprise blade center support section 25 and, in this embodiment, a first blade support extension 26 intermediate center section 25 and one of the side planes 4; and a second blade support extension 28 intermediate the center section 25 and the second side plate 4. Each of the center section 25, the first extension 26, and the second extension 28 contains respectively their segmented blade member 25A, segmented blade member 26A, and segmented member 28A; the said blade members comprising in conjunction the overall first blade member 24A.

In an analagous manner, the second blade support 30 is an essentially triangular, angled ductile metal structure supporting on its forward lower apex a second blade member 30A. The second blade support 30 further comprises a center section 31; a first blade support extension 32 intermediate the center section 31 and one of the side plates 4; and a second blade support extension 34 intermediate the center section 31 and the second side plate 4. Similarly, each of the center section 31, the first extension 32, and the second extension 34 contains mounted fixedly to its forward lower apex, blade segments member 31A, 32A and 34A. These blade segment members in turn comprise in total second blade member 30A.

The individual segments and extensions heretofore described of the forward cross member 12 and the aft cross member 18 are interconnected by the provision of cross member square flanges 36 on each of the two ends of the forward cross member center section 13, the first cross member extension 14, the second cross member extension 16, the aft cross member center extension 19, the first cross member extension 20, and the second cross member extension 22. Each of these components is identically formed with the cross member square flange 36 perpendicularly terminating each of the two ends of each of the segment members. The listed members are assembled as described above and fastened intermediate the side plates 4 by means of the bolt assemblies 37, which interconnect the cross member square flanges 36 with respect to each other and also with respect to the side plates 4.

Each of the components of the first blade support 24 and the second blade support 30 are terminated on each of their ends by the unique blade support arc flange 38. The design of the blade support arc flange 38 provides substantial strength and impact resistance permitting the first blades supports 24 and the second blade support 30 to be constructed of segments as before described.

Each of the blade support arc flanges 38 comprise an essentially arcuate plane having a lower forward point 40 corresponding to a point extended from the apex of the first blade support 24 or the second blade support 30. Point 40 is adjacent to the point formed by the forward cutting edge of the first blade member 24A and the second blade 30A. Flange 38 then arises aft along hypotenuse side 42 descends curvingly along back arc 44 and is completed by a bottom edge 46 forming an essentially circular triangle section. Bottom edge 46 is located adjacent to greater plane 7. A series of arc bolts 48 and edge bolts 50 secure each of the blade support arc flanges 38 with respect to each other and with respect to the side plates 4 along two sides of the blade support arc flange 38.

Since as stated above, first blade support 24 and second blade support 30 are intermediate side plates 4, the arc bolts 48 and edge bolts 50 of the outer blade support arc flanges 38 of the blade supports 24 and 30 define a bolt array pattern 52 on side plates 4. There are three such side plate bolt arrays 52 defined on side plate 4. In the preferred embodiment of the invention, the three side plate bolt arrays 52 are located so that the respective installation of the blade supports 24 and 30 in each of the first, the second, or the third of the side plate bolt arrays 52 cause the bottom edge 46 of the respective blade support arc flanges 38 to define one of three greater planes 7. Each of these three greater planes 7 has been found to be a most effective or preferred position for the grading of a particular class of ground media by the overall grader 2. In the preferred embodiment of the grader 2, it is found that the grader plane 7 should with respect to the side plate base plane 6 be in the first position. Grader plane 7 two inches above side plate base plane 6; in the second position, grader plane 7 should be coplanar with side plate base plane 6; and in the third position grader plane 7 should be two to three inches below side plate base plane 6.

In operation, the grader 2 is attached to a standard three point hitch on a tractor, not shown, by connecting the three point hitch on a tractor, not shown, by connecting the three point hitch at the four hitch points 54 found intermediate the top edge of four cross member center section 13 and a provided aft hitch point 58 found centered atop the center extension 19 of the aft cross member 18. The grader 2 being so installed may be raised, lowered and dragged by manipulation of the controls found upon the tractor as is well known.

Depending upon the media to be graded, each of the first blade support 24, and the second blade support 30 are installed in the first, the second, or the third side plate bolt array 52 by connecting with bolts through the provided arc bolt 48 and edge bolts 50 on the respective blade support arc flanges 38. It is found that if in addition, the blade members 24A and 30A are at a forty-five degree angle at the point of contact with the ground media, this angle determined by the overall construction of the angle of the first blade support 24 and the second blade support 30, that the most effective grading will occur.

It can also be seen that various widths of graders can readily be constructed by removing or adding additional cross member extensions and blade support extensions to the four cross member 12, the aft cross member 18, the first blade support 24, and the second blade support 30. It is therefore, preferable that the center sections 13, 19, 25, and 31 be of a dimension equal to the narrowest width desired for the overall grader 2 and that the cross-member extensions 14, 16, 20 and 22 together with the blade support extensions 26, 28, 32, and 34, should all be of identical widths.

In the preferred embodiment of the invention described herein, each of the center sections enumerated above is four feet wide each of the cross member or blade support extensions enumerated above is one foot wide. The above pattern permits the construction of rugged, reliable, and efficient graders 2 in widths varying from four to fourteen feet. These widths have been found in practice to encompass the entire desirable range of widths for commonly encountered earth grading and earth shaving tasks suitable for the tractor and blade combination described herein.

It can thus be seen that the above described invention, involving both an innovative and effective method of constructing a variety of graders of varying widths of equal effectiveness, together with the specific pattern shown for achieving a particularly effective grader for a number of various media expected to be encountered encompasses a variety of equivalent constructions wider than that discussed in the specific preferred embodiment given as an example above. The actual invention claimed herein therefore, is that broader range of equivalents described in the claims.

I claim:

1. An adjustable spreader-grader apparatus comprising:

two spaced side plates each having lower plate edges adapted to ride on the media to be graded, a forward blade carrier means positioned laterally between said side plates, a forward blade secured to said forward blade carrier means, said forward blade carrier means having opposite lateral first and second forward ends, a removable foward blade carrier insert having lateral first and second insert ends, a forward insert blade secured to said forward blade carrier insert, said forward blade and said forward insert blade generally forming a continuous generally transverse ground media grading blade when said forward blade carrier insert is connected between said side plates, which grading blade is longer than said foward blade alone, a first forward connecting means for removably connecting said first insert end to said first forward end, a second foward connecting means for removably connecting said second insert end to one said side plate, a rear blade carrier means positioned laterally between said side plates, a rear blade secured to said rear blade carrier means, said rear blade carrier means having opposite lateral first and second rear ends, a removable rear blade carrier insert having lateral first and second rear insert ends, a rear insert blade secured to said rear blade carrier insert, said rear blade and said rear insert blade generally forming a continuous generally transverse ground media grading blade when said rear blade carrier insert is connected between said side plates, which grading blade is longer than said rear blade alone, a first rear connecting means for removably connecting said first rear insert end to said first rear end, a second rear connecting means for removably connecting said second rear insert end to said one said side plate, a bracing means extending laterally between said side plates, said bracing means having opposite lateral first and second bracing ends, a removable bracing insert having opposite lateral first and second bracing insert ends, a first bracing connecting means for removably connecting said first bracing end to said first bracing insert end, a second bracing connecting means for removably connecting said second bracing insert end to said one said side plate, a connecting means for connecting said second forward end, said second rear end, and said second bracing end to the other said side plate, and a hitching means connected to said bracing means for hitching said apparatus to a tractor.

2. The apparatus of claim 1 including, said first and second forward connecting means, said first and second rear connecting means, and said first and second brace connecting means each comprising removable bolt means.

3. The apparatus of claim 1 including, said connecting means including a removable connecting means for removably connecting said second forward end to the other said side plate, and said second forward connecting means and said removable connecting means providing for first, second and third alternative vertical positions of the lower edges of said forward blade and said forward insert blade relative to said lower plate edges.

4. The apparatus of claim 3 including, said first, second, and third positions of said lower edges of said forward blade and said forward insert blade being, respectively, two inches above, in the same plane as, and two inches below said lower plate edges.

5. The apparatus of claim 3 including, each said first, second and third positions providing for a 45 degree angle of said forward blade and said forward insert blade with respect to said lower plate edges.

6. The apparatus of claim 3 including said second forward connecting means including, said second insert end having an insert pattern of bolt-through holes through it, and said one said side plate having spaced first, second and third patterns of bolt-through holes through it adapted such that said insert pattern can be placed alternatively in registration with said first, second and third patterns and a plurality of bolts inserted therethrough to define, respectively and alternatively, said first, second and third positions.

7. The apparatus of claim 1 including, said second forward connecting means including a flange secured perpendicularly to said second insert end and having a flange pattern of bolt-through holes and a plurality of bolt means passing through said bolt-through holes and said one said side plate.

8. The apparatus of claim 1 including, said forward blade having a lower forward blade cutting edge, said forward insert blade having a lower forward insert blade cutting edge, and said first forward connecting means connecting said forward blade carrier means and said forward blade carrier insert such that said lower forward blade cutting edge and said lower foward insert blade cutting edge are aligned and form generally a straight line.

9. The apparatus of claim 1 including, said forward blade carrier insert, said rear blade carrier insert, and said bracing insert, when connected to said one said side plate and to, respectively said forward blade carrier means, said rear blade carrier means, and said bracing means, increasing the distance between said side plates.

10. The apparatus of claim 1 including, said bracing insert when connected by said first and second bracing connecting means increasing the distance between said side plates and thus the width of said apparatus.

11. The apparatus of claim 1 including, said connecting means including an apparatus width increasing insert means for further increasing the distance between said side plates.

* * * * *